US008970434B2

(12) United States Patent
Kanj et al.

(10) Patent No.: US 8,970,434 B2
(45) Date of Patent: Mar. 3, 2015

(54) COMPACT BROADBAND ANTENNA

(75) Inventors: Houssam Kanj, Waterloo (CA); Huanhuan Gu, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 250 days.

(21) Appl. No.: 13/442,418

(22) Filed: Apr. 9, 2012

(65) Prior Publication Data

US 2013/0265201 A1 Oct. 10, 2013

(51) Int. Cl.
*H01Q 1/38* (2006.01)
*H01Q 9/04* (2006.01)
*H01Q 1/24* (2006.01)

(52) U.S. Cl.
CPC ..... *H01Q 9/0421* (2013.01); *H01Q 1/243* (2013.01)
USPC ..... 343/700 MS; 343/702

(58) Field of Classification Search
CPC ..... H01Q 1/38; H01Q 1/243; H01Q 9/0421
USPC ..... 343/700 MS, 702, 846
See application file for complete search history.

(56) References Cited

U.S. PATENT DOCUMENTS 6,670,923 B1 * 12/2003 Kadambi et al. ..... 343/700 MS
6,762,723 B2 * 7/2004 Nallo et al. ..... 343/700 MS
6,836,246 B1 * 12/2004 Kadambi et al. ..... 343/700 MS
7,312,760 B1 12/2007 Cheng
7,375,685 B1 * 5/2008 Nalbandian ..... 343/700 MS
2002/0019247 A1 2/2002 Egorov

FOREIGN PATENT DOCUMENTS

WO 0074171 A1 12/2000
WO 2004047220 A1 6/2004

OTHER PUBLICATIONS

European Extended Search Report; Application No. 13162762.2; Dec. 8, 2014; 6 pages.

* cited by examiner

*Primary Examiner* — Hoanganh Le
(74) *Attorney, Agent, or Firm* — Conley Rose, P.C.; J. Robert Brown, Jr.

(57) ABSTRACT

A compact broadband antenna is disclosed. In various embodiments, the broadband antenna comprises a folded inverted F radiator. The folded inverted F radiator comprises a first L-shaped element comprising an arm portion and a rectangular portion, a feed element coupled to a feed source and to the L-shaped element and a shorting element coupled to ground. In some embodiments, the antenna further comprises a second L-shaped arm providing an additional current path to enhance performance of the antenna. In other embodiments, the antenna further comprises a capacitive coupling patch comprising a rectangular portion that is substantially coplanar with said rectangular portion of the L-shaped element.

19 Claims, 14 Drawing Sheets

COMPACT BROADBAND ANTENNA

BACKGROUND OF THE DISCLOSURE

1. Field of the Disclosure

The present disclosure is directed in general to communication systems and methods for operating same. More particularly, embodiments of the disclosure provide an improved compact broadband antenna.

2. Description of the Related Art

As many wireless devices evolve toward slimmer form factors, there will a need for more compact antennas. Also users often would like to place their mobile phone on a desk charger and connect it to their computers. These needs become a challenge problem for antenna designers for the wireless device designs. Usually the antenna is placed at the bottom of the mobile phone and requires a predetermined clearance space. However when the USB port is placed on the bottom, it requires that the antenna volume be split into two portions. Also the USB port may introduce electromagnetic signals that interfere with the antenna's performance. Therefore, the antenna needs to be carefully designed to address these problems.

In some wireless devices, the solution to this problem is to use one of the two parts of a disconnected metal ring surrounding the mobile phone housing as the antenna. However this approach might cause signal mitigation when people hold their phone in a certain way. This is mainly because the hand is a good conductor and therefore it will change the antenna's performance when the hand connects the two separated metal rings.

Folded inverted F antennas have been used in many wireless applications to provide a very compact, effective antenna. However, the placement of a USB port, or other port, in the bottom of the wireless device still creates the problems listed above. Thus, despite the advances in the art as described above, there is a need for an improved compact broadband antenna for use in wireless communication devices, especially those comprising a USB port, or other port, in close proximity to the antenna. Such an improved compact broadband antenna is provided by the embodiments of the disclosure as described in greater detail below.

BRIEF DESCRIPTION OF THE DRAWINGS

The present disclosure may be understood, and its numerous objects, features and advantages obtained, when the following detailed description is considered in conjunction with the following drawings, in which.

DETAILED DESCRIPTION

Figure 1:
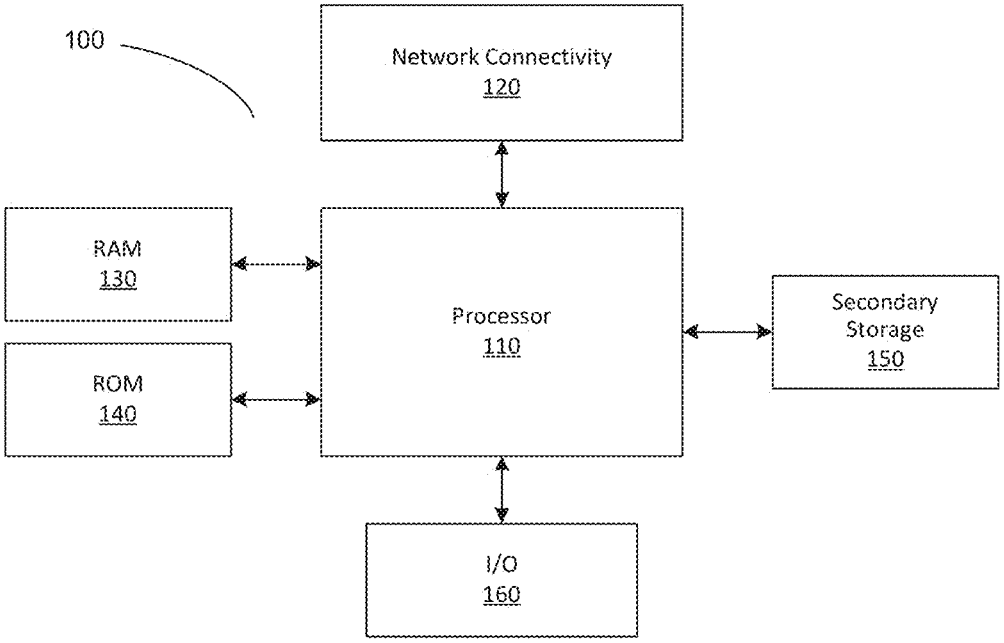
FIG. 1 is an illustration of a communication system in which the present disclosure may be implemented.

Embodiments of the disclosure provide a high band antenna solution for the design of slim mobile phones with a USB port at the bottom. The embodiments disclosed herein are particularly useful for wireless devices in which the main antenna is split into two radiators, with each of the radiators covering a specific band, e.g., one for a low band, e.g., 824-960 MHz, and another for a high band, e.g., 1710-2170 MHz, with the presence of bottom USB port. In particular, the embodiments disclosed herein are especially effective for implementing a high band radiator.

Various illustrative embodiments of the present disclosure will now be described in detail with reference to the accompanying figures. While various details are set forth in the following description, it will be appreciated that the present disclosure may be practiced without these specific details, and that numerous implementation-specific decisions may be made to the disclosure described herein to achieve the inventor's specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flowchart form, rather than in detail, in order to avoid limiting or obscuring the present disclosure. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, software, a combination of hardware and software, or software in execution. For example, a component may be, but is not limited to being, a processor, a process running on a processor, an object, an executable, a thread of execution, a program, or a computer. By way of illustration, both an application running on a computer and the computer itself can be a component. One or more components may reside within a process or thread of execution and a component may be localized on one computer or distributed between two or more computers.

As likewise used herein, the term "node" broadly refers to a connection point, such as a redistribution point or a communication endpoint, of a communication environment, such as a network. Accordingly, such nodes refer to an active electronic device capable of sending, receiving, or forwarding information over a communications channel. Examples of such nodes include data circuit-terminating equipment (DCE), such as a modem, hub, bridge or switch, and data terminal equipment (DTE), such as a handset, a printer or a host computer (e.g., a router, workstation or server). Examples of local area network (LAN) or wide area network (WAN) nodes include computers, packet switches, cable modems, Data Subscriber Line (DSL) modems, and wireless LAN (WLAN) access points. Examples of Internet or Intranet nodes include host computers identified by an Internet Protocol (IP) address, bridges and WLAN access points. Likewise, examples of nodes in cellular communication include base stations, relays, base station controllers, radio network controllers, home location registers, Gateway GPRS Support Nodes (GGSN), Serving GPRS Support Nodes (SGSN), Serving Gateways (S-GW), and Packet Data Network Gateways (PDN-GW).

Other examples of nodes include client nodes, server nodes, peer nodes and access nodes. As used herein, a client node may refer to wireless devices such as mobile telephones, smart phones, personal digital assistants (PDAs), handheld devices, portable computers, tablet computers, and similar devices or other user equipment (UE) that has telecommunications capabilities. Such client nodes may likewise refer to a mobile, wireless device, or conversely, to devices that have similar capabilities that are not generally transportable, such as desktop computers, set-top boxes, or sensors. Likewise, a server node, as used herein, refers to an information processing device (e.g., a host computer), or series of information processing devices, that perform information processing requests submitted by other nodes. As likewise used herein, a peer node may sometimes serve as client node, and at other times, a server node. In a peer-to-peer or overlay network, a node that actively routes data for other networked devices as well as itself may be referred to as a supernode.

An access node, as used herein, refers to a node that provides a client node access to a communication environment. Examples of access nodes include cellular network base stations and wireless broadband (e.g., WiFi, WiMAX, LTE, etc) access points, which provide corresponding cell and WLAN coverage areas. As used herein, a macrocell is used to generally describe a traditional cellular network cell coverage area. Such macrocells are typically found in rural areas, along highways, or in less populated areas. As likewise used herein, a microcell refers to a cellular network cell with a smaller coverage area than that of a macrocell. Such micro cells are typically used in a densely populated urban area. Likewise, as used herein, a picocell refers to a cellular network coverage area that is less than that of a microcell. An example of the coverage area of a picocell may be a large office, a shopping mall, or a train station. A femtocell, as used herein, currently refers to the smallest commonly accepted area of cellular network coverage. As an example, the coverage area of a femtocell is sufficient for homes or small offices.

In general, a coverage area of less than two kilometers typically corresponds to a microcell, 200 meters or less for a picocell, and on the order of 10 meters for a femtocell. As likewise used herein, a client node communicating with an access node associated with a macrocell is referred to as a "macrocell client." Likewise, a client node communicating with an access node associated with a microcell, picocell, or femtocell is respectively referred to as a "microcell client," "picocell client," or "femtocell client."

The term "article of manufacture" (or alternatively, "computer program product") as used herein is intended to encompass a computer program accessible from any computer-readable device or media. For example, computer readable media can include but are not limited to magnetic storage devices (e.g., hard disk, floppy disk, magnetic strips, etc.), optical disks such as a compact disk (CD) or digital versatile disk (DVD), smart cards, and flash memory devices (e.g., card, stick, etc.).

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

FIG. 1 illustrates an example of a system 100 suitable for implementing one or more embodiments disclosed herein. In various embodiments, the system 100 comprises a processor 110, which may be referred to as a central processor unit (CPU) or digital signal processor (DSP), network connectivity interfaces 120, random access memory (RAM) 130, read only memory (ROM) 140, secondary storage 150, and input/output (I/O) devices 160. In some embodiments, some of these components may not be present or may be combined in various combinations with one another or with other components not shown. These components may be located in a single physical entity or in more than one physical entity. Any actions described herein as being taken by the processor 110 might be taken by the processor 110 alone or by the processor 110 in conjunction with one or more components shown or not shown in FIG. 1.

The processor 110 executes instructions, codes, computer programs, or scripts that it might access from the network connectivity interfaces 120, RAM 130, or ROM 140. While only one processor 110 is shown, multiple processors may be present. Thus, while instructions may be discussed as being executed by a processor 110, the instructions may be executed simultaneously, serially, or otherwise by one or multiple processors 110 implemented as one or more CPU chips.

In various embodiments, the network connectivity interfaces 120 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, long term evolution (LTE) radio transceiver devices, worldwide interoperability for microwave access (WiMAX) devices, and/or other well-known interfaces for connecting to networks, including Personal Area Networks (PANs) such as Bluetooth. These network connectivity interfaces 120 may enable the processor 110 to communicate with the Internet or one or more telecommunications networks or other networks from which the processor 110 might receive information or to which the processor 110 might output information.

The network connectivity interfaces 120 may also be capable of transmitting or receiving data wirelessly in the form of electromagnetic waves, such as radio frequency signals or microwave frequency signals. Information transmitted or received by the network connectivity interfaces 120 may include data that has been processed by the processor 110 or instructions that are to be executed by processor 110. The data may be ordered according to different sequences as may be desirable for either processing or generating the data or transmitting or receiving the data.

In various embodiments, the RAM 130 may be used to store volatile data and instructions that are executed by the processor 110. The ROM 140 shown in FIG. 1 may likewise be used to store instructions and data that is read during execution of the instructions. The secondary storage 150 is typically comprised of one or more disk drives or tape drives and may be used for non-volatile storage of data or as an overflow data storage device if RAM 130 is not large enough to hold all working data. Secondary storage 150 may likewise be used to store programs that are loaded into RAM 130 when such programs are selected for execution. The I/O devices 160 may include liquid crystal displays (LCDs), Light Emitting Diode (LED) displays, Organic Light Emitting Diode (OLED) displays, projectors, televisions, touch screen displays, keyboards, keypads, switches, dials, mice, track balls, voice recognizers, card readers, paper tape readers, printers, video monitors, or other well-known input/output devices.

Figure 2:
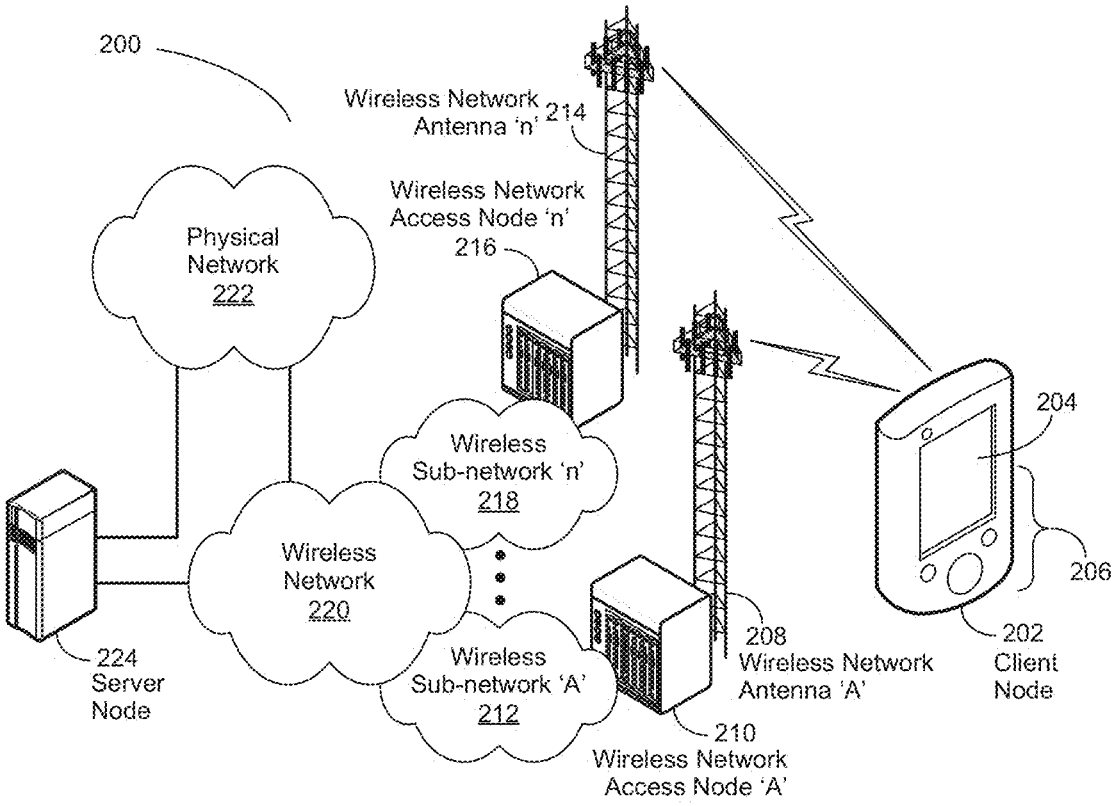
FIG. 2 shows a wireless-enabled communications environment including an embodiment of a client node.

FIG. 2 shows a wireless-enabled communications environment including an embodiment of a client node as implemented in an embodiment of the disclosure. Though illustrated as a mobile phone, the client node 202 may take various forms including a wireless handset, a pager, a smart phone, or a personal digital assistant (PDA). In various embodiments, the client node 202 may also comprise a portable computer, a tablet computer, a laptop computer, or any computing device operable to perform data communication operations. Many suitable devices combine some or all of these functions. In some embodiments, the client node 202 is not a general purpose computing device like a portable, laptop, or tablet computer, but rather is a special-purpose communications device such as a telecommunications device installed in a vehicle. The client node 202 may likewise be a device, include a device, or be included in a device that has similar capabilities but that is not transportable, such as a desktop computer, a set-top box, or a network node. In these and other embodiments, the client node 202 may support specialized activities such as gaming, inventory control, job control, task management functions, and so forth.

In various embodiments, the client node 202 includes a display 204. In these and other embodiments, the client node 202 may likewise include a touch-sensitive surface, a keyboard or other input keys 206 generally used for input by a user. The input keys 206 may likewise be a full or reduced alphanumeric keyboard such as QWERTY, Dvorak, AZERTY, and sequential keyboard types, or a traditional numeric keypad with alphabet letters associated with a telephone keypad. The input keys 206 may likewise include a trackwheel, an exit or escape key, a trackball, and other navigational or functional keys, which may be inwardly depressed to provide further input function. The client node 202 may likewise present options for the user to select, controls for the user to actuate, and cursors or other indicators for the user to direct.

The client node 202 may further accept data entry from the user, including numbers to dial or various parameter values for configuring the operation of the client node 202. The client node 202 may further execute one or more software or firmware applications in response to user commands. These applications may configure the client node 202 to perform various customized functions in response to user interaction. Additionally, the client node 202 may be programmed or configured over-the-air (OTA), for example from a wireless network access node 'A' 210 through 'n' 216 (e.g., a base station), a server node 224 (e.g., a host computer), or a peer client node 202.

Among the various applications executable by the client node 202 are a web browser, which enables the display 204 to display a web page. The web page may be obtained from a server node 224 through a wireless connection with a wireless network 220. As used herein, a wireless network 220 broadly refers to any network using at least one wireless connection between two of its nodes. The various applications may likewise be obtained from a peer client node 202 or other system over a connection to the wireless network 220 or any other wirelessly-enabled communication network or system.

In various embodiments, the wireless network 220 comprises a plurality of wireless sub-networks (e.g., cells with corresponding coverage areas) 'A' 212 through 'n' 218. As used herein, the wireless sub-networks 'A' 212 through 'n' 218 may variously comprise a mobile wireless access network or a fixed wireless access network. In these and other embodiments, the client node 202 transmits and receives communication signals, which are respectively communicated to and from the wireless network nodes 'A' 210 through 'n' 216 by wireless network antennas 'A' 208 through 'n' 214 (e.g., cell towers). In various embodiments described hereinbelow, an access node may use multiple antennas simultaneously to transmit data to a client node that uses multiple antennas simultaneously to receive the data. In turn, the communication signals are used by the wireless network access nodes 'A' 210 through 'n' 216 to establish a wireless communication session with the client node 202. As used herein, the network access nodes 'A' 210 through 'n' 216 broadly refer to any access node of a wireless network. As shown in FIG. 2, the wireless network access nodes 'A' 210 through 'n' 216 are respectively coupled to wireless sub-networks 'A' 212 through 'n' 218, which are in turn connected to the wireless network 220.

In various embodiments, the wireless network 220 is coupled to a physical network 222, such as the Internet. Via the wireless network 220 and the physical network 222, the client node 202 has access to information on various hosts, such as the server node 224. In these and other embodiments, the server node 224 may provide content that may be shown on the display 204 or used by the client node processor 110 for its operations. Alternatively, the client node 202 may access the wireless network 220 through a peer client node 202 acting as an intermediary, in a relay type or hop type of connection. As another alternative, the client node 202 may be tethered and obtain its data from a linked device that is connected to the wireless network 220. Skilled practitioners of the art will recognize that many such embodiments are possible and the foregoing is not intended to limit the spirit, scope, or intention of the disclosure.

Figure 3:
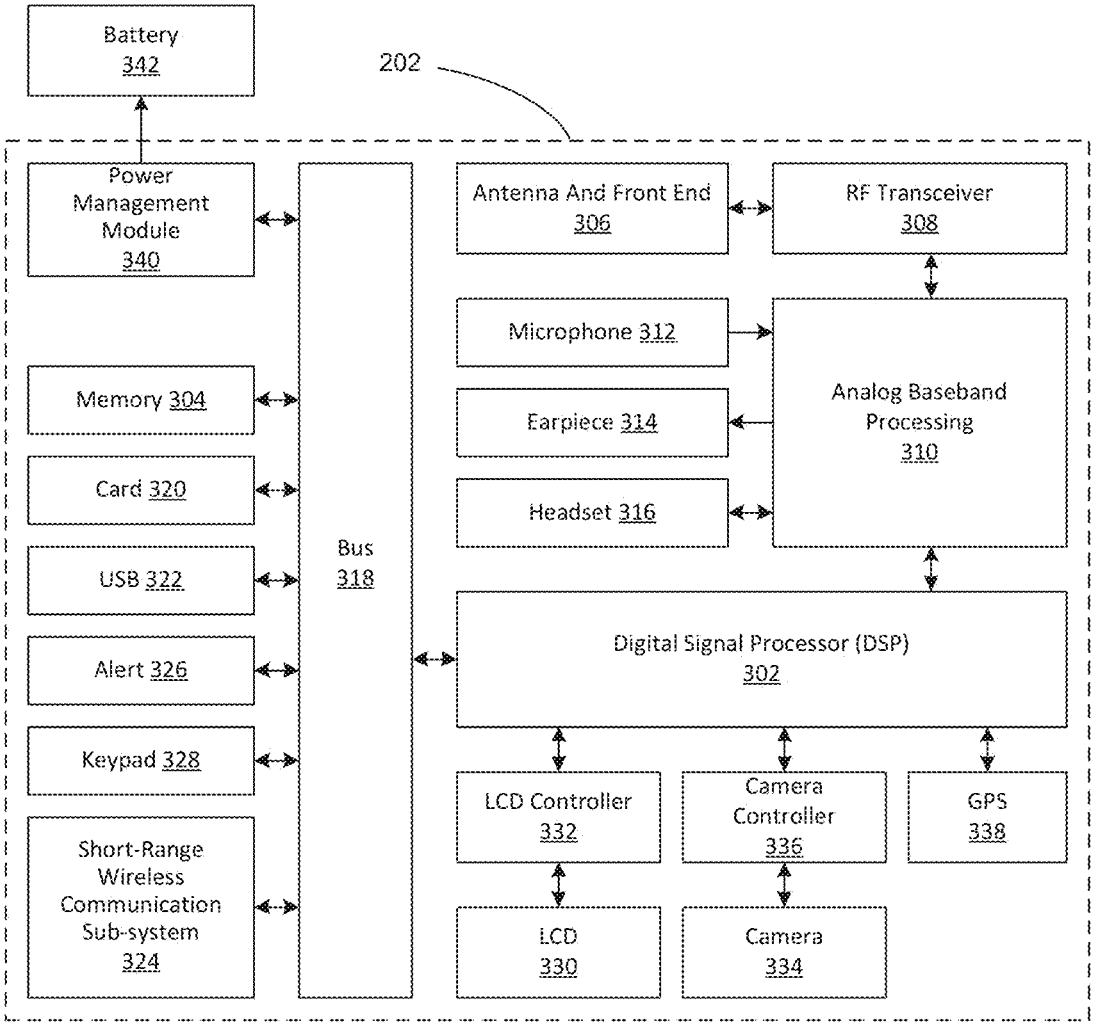
FIG. 3 is a simplified block diagram of an exemplary client node comprising a digital signal processor (DSP)

FIG. 3 depicts a block diagram of an exemplary client node as implemented with a digital signal processor (DSP) in accordance with an embodiment of the disclosure. While various components of a client node 202 are depicted, various embodiments of the client node 202 may include a subset of the listed components or additional components not listed. As shown in FIG. 3, the client node 202 includes a DSP 302 and a memory 304. As shown, the client node 202 may further include an antenna and front end unit 306, a radio frequency (RF) transceiver 308, an analog baseband processing unit 310, a microphone 312, an earpiece speaker 314, a headset port 316, a bus 318, such as a system bus or an input/output (I/O) interface bus, a removable memory card 320, a universal serial bus (USB) port 322, a short range wireless communication sub-system 324, an alert 326, a keypad 328, a liquid crystal display (LCD) 330, which may include a touch sensitive surface, an LCD controller 332, a charge-coupled device (CCD) camera 334, a camera controller 336, and a global positioning system (GPS) sensor 338, and a power management module 340 operably coupled to a power storage unit, such as a battery 342. In various embodiments, the client node 202 may include another kind of display that does not provide a touch sensitive screen. In one embodiment, the DSP 302 communicates directly with the memory 304 without passing through the input/output interface 318.

In various embodiments, the DSP 302 or some other form of controller or central processing unit (CPU) operates to control the various components of the client node 202 in accordance with embedded software or firmware stored in memory 304 or stored in memory contained within the DSP 302 itself. In addition to the embedded software or firmware, the DSP 302 may execute other applications stored in the memory 304 or made available via information carrier media such as portable data storage media like the removable memory card 320 or via wired or wireless network communications. The application software may comprise a compiled set of machine-readable instructions that configure the DSP 302 to provide the desired functionality, or the application software may be high-level software instructions to be processed by an interpreter or compiler to indirectly configure the DSP 302.

The antenna and front end unit 306 may be provided to convert between wireless signals and electrical signals, enabling the client node 202 to send and receive information from a cellular network or some other available wireless communications network or from a peer client node 202. In an embodiment, the antenna and front end unit 106 may include multiple antennas to support beam forming and/or multiple input multiple output (MIMO) operations. As is known to those skilled in the art, MIMO operations may provide spatial diversity which can be used to overcome difficult channel conditions or to increase channel throughput. Likewise, the antenna and front end unit 306 may include antenna tuning or impedance matching components, RF power amplifiers, or low noise amplifiers.

In various embodiments, the RF transceiver 308 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 310 or the DSP 302 or other central processing unit. In some embodiments, the RF Transceiver 308, portions of the Antenna and Front End 306, and the analog base band processing unit 310 may be combined in one or more processing units and/or application specific integrated circuits (ASICs).

The analog baseband processing unit 310 may provide various analog processing of inputs and outputs, for example analog processing of inputs from the microphone 312 and the headset 316 and outputs to the earpiece 314 and the headset 316. To that end, the analog baseband processing unit 310 may have ports for connecting to the built-in microphone 312 and the earpiece speaker 314 that enable the client node 202 to be used as a cell phone. The analog baseband processing unit 310 may further include a port for connecting to a headset or other hands-free microphone and speaker configuration. The analog baseband processing unit 310 may provide digital-to-analog conversion in one signal direction and analog-to-digital conversion in the opposing signal direction. In various embodiments, at least some of the functionality of the analog baseband processing unit 310 may be provided by digital processing components, for example by the DSP 302 or by other central processing units.

The DSP 302 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 302 may perform modulation, coding, interleaving, and spreading, and for a receiver function the DSP 302 may perform despreading, deinterleaving, decoding, and demodulation. In another embodiment, for example in an orthogonal frequency division multiplex access (OFDMA) technology application, for the transmitter function the DSP 302 may perform modulation, coding, interleaving, inverse fast Fourier transforming, and cyclic prefix appending, and for a receiver function the DSP 302 may perform cyclic prefix removal, fast Fourier transforming, deinterleaving, decoding, and demodulation. In other wireless technology applications, yet other signal processing functions and combinations of signal processing functions may be performed by the DSP 302.

The DSP 302 may communicate with a wireless network via the analog baseband processing unit 310. In some embodiments, the communication may provide Internet connectivity, enabling a user to gain access to content on the Internet and to send and receive e-mail or text messages. The input/output interface 318 interconnects the DSP 302 and various memories and interfaces. The memory 304 and the removable memory card 320 may provide software and data to configure the operation of the DSP 302. Among the interfaces may be the USB interface 322 and the short range wireless communication sub-system 324. The USB interface 322 may be used to charge the client node 202 and may also enable the client node 202 to function as a peripheral device to exchange information with a personal computer or other computer system. The short range wireless communication sub-system 324 may include an infrared port, a Bluetooth interface, an IEEE 802.11 compliant wireless interface, or any other short range wireless communication sub-system, which may enable the client node 202 to communicate wirelessly with other nearby client nodes and access nodes.

The input/output interface 318 may further connect the DSP 302 to the alert 326 that, when triggered, causes the client node 202 to provide a notice to the user, for example, by ringing, playing a melody, or vibrating. The alert 326 may serve as a mechanism for alerting the user to any of various events such as an incoming call, a new text message, and an appointment reminder by silently vibrating, or by playing a specific pre-assigned melody for a particular caller.

The keypad 328 couples to the DSP 302 via the I/O interface 318 to provide one mechanism for the user to make selections, enter information, and otherwise provide input to the client node 202. The keyboard 328 may be a full or reduced alphanumeric keyboard such as QWERTY, Dvorak, AZERTY and sequential types, or a traditional numeric keypad with alphabet letters associated with a telephone keypad. The input keys may likewise include a trackwheel, an exit or escape key, a trackball, and other navigational or functional keys, which may be inwardly depressed to provide further input function. Another input mechanism may be the LCD 330, which may include touch screen capability and also display text and/or graphics to the user. The LCD controller 332 couples the DSP 302 to the LCD 330.

The CCD camera 334, if equipped, enables the client node 202 to take digital pictures. The DSP 302 communicates with the CCD camera 334 via the camera controller 336. In another embodiment, a camera operating according to a technology other than Charge Coupled Device cameras may be employed. The GPS sensor 338 is coupled to the DSP 302 to decode global positioning system signals or other navigational signals, thereby enabling the client node 202 to determine its position. Various other peripherals may also be included to provide additional functions, such as radio and television reception.

Figure 4:
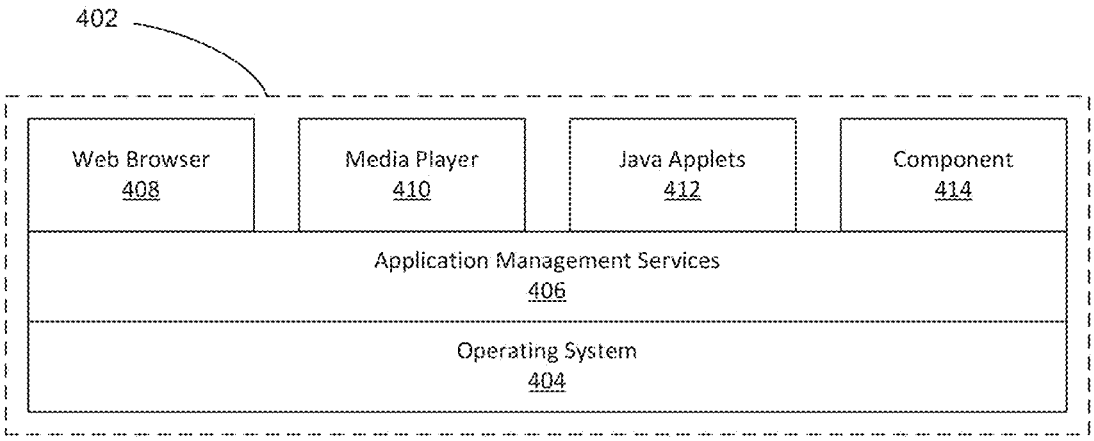
FIG. 4 is a simplified block diagram of a software environment that may be implemented by a DSP.

FIG. 4 illustrates a software environment 402 that may be implemented by a digital signal processor (DSP). In this embodiment, the DSP 302 shown in FIG. 3 executes an operating system 404, which provides a platform from which the rest of the software operates. The operating system 404 likewise provides the client node 202 hardware with standardized interfaces (e.g., drivers) that are accessible to application software. The operating system 404 likewise comprises application management services (AMS) 406 that transfer control between applications running on the client node 202. Also shown in FIG. 4 are a web browser application 408, a media player application 410, and Java applets 412. The web browser application 408 configures the client node 202 to operate as a web browser, allowing a user to enter information into forms and select links to retrieve and view web pages. The media player application 410 configures the client node 202 to retrieve and play audio or audiovisual media. The Java applets 412 configure the client node 202 to provide games, utilities, and other functionality. A component 414 may provide functionality described herein. In various embodiments, the client node 202, the wireless network nodes 'A' 210 through 'n' 216, and the server node 224 shown in FIG. 2 may likewise include a processing component that is capable of executing instructions related to the actions described above.

Figure 5:
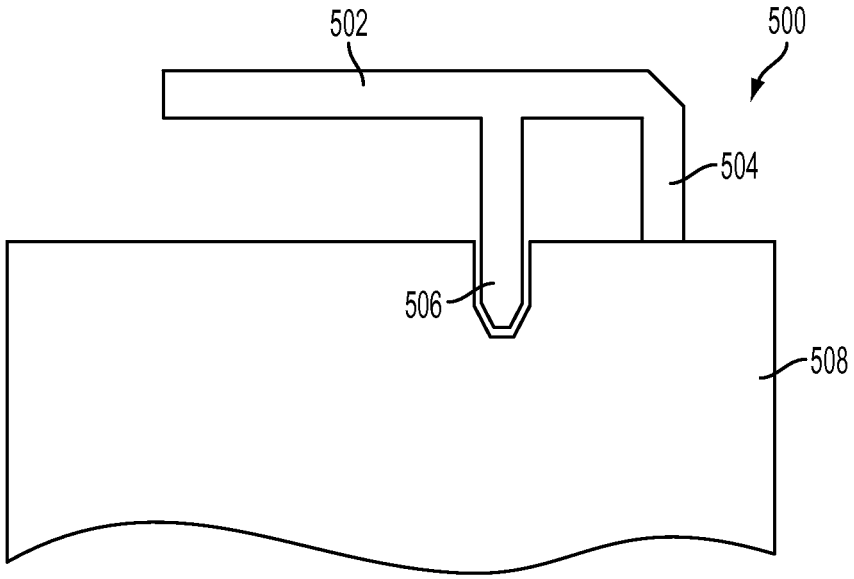
FIGURE 5 PRIOR ART
FIG. 5 is a diagram of a prior art planar (i.e., non-folded) inverted-F antenna.

FIG. 5 shows the schematic diagram of a prior art planar (i.e., non-folded) inverted-F antenna. The planar inverted-F antenna 500 mainly comprises a radiating unit 502, a ground plane 508, a dielectric material (not shown), a shorting element 504 and a feeding element 506. The radiating unit 502 is coupled to the ground plane 508 through the shorting element 504. The feeding element 506 is arranged on the ground plane 508 and is coupled to the radiating unit 502 for signal transmission. The radiating unit 502 and the ground plane 508 can be implemented with metallic material. The radiating unit 502 is designed with specific pattern for achieving desired operating wavelength and radiation performance.

Figure 6:
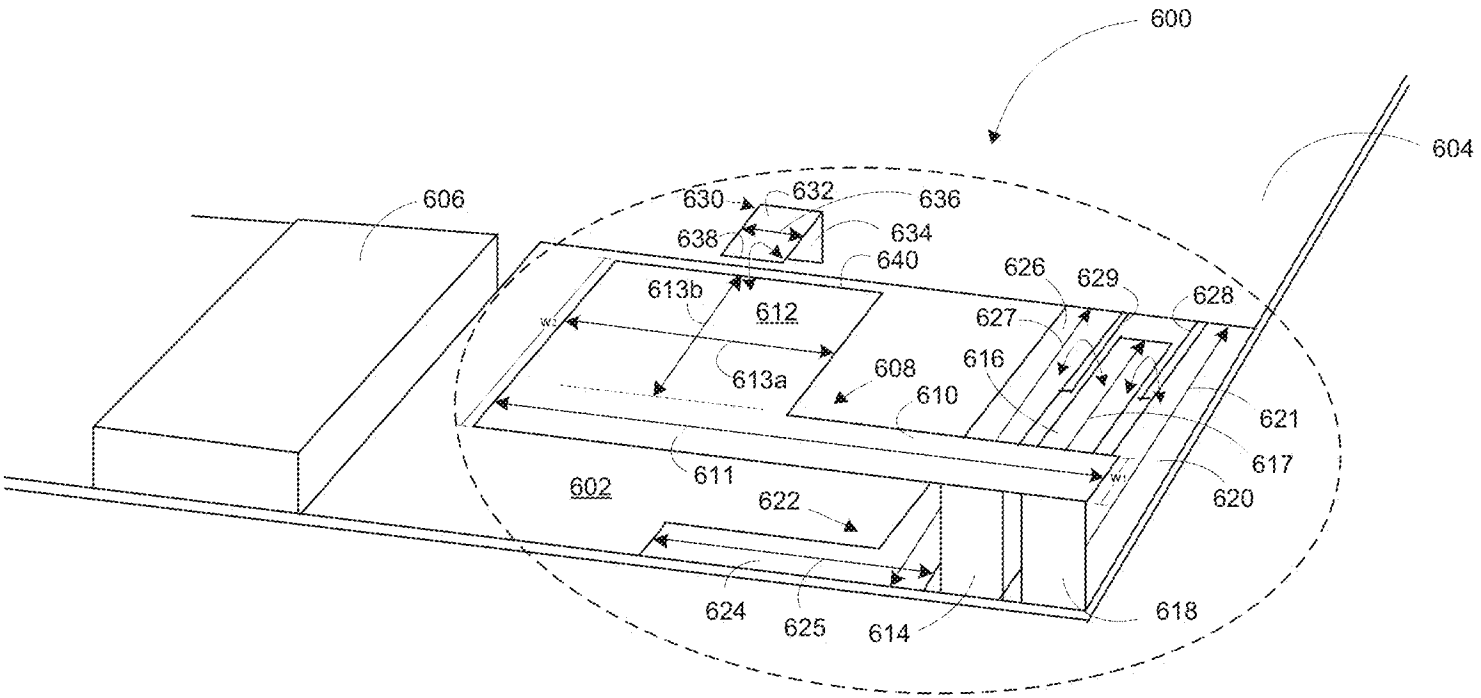
FIG. 6 is an illustration of an embodiment of the compact broadband antenna of the present disclosure, wherein the antenna comprises a folded PIFA implementation.

FIG. 6 is an illustration of an embodiment of the compact broadband antenna 600 of the present disclosure, wherein the antenna comprises a folded inverted F antenna implementation disposed on a circuit board 602 comprising a ground plane 604. In the embodiment shown in FIG. 6, the antenna 600 is disposed in close proximity to a port 606, which may be a USB port. The antenna 600 is broadly comprised of an L-shaped radiator 608 comprising an elongated rectangular arm portion 610 having a longitudinal axis 611 and a rectangular portion 612 having a longitudinal axis 613*a* that is parallel to axis 611 and a transverse axis 613*b* that is perpendicular to axis 613*a*. The operational parameters of the L-shaped radiator 608 can be modified by changing the dimensions of the rectangular portion 612 along axes 613*a* and 613*b*, as discussed in greater detail below.

In the embodiment shown in FIG. 6, a first end of the L-shaped radiator, that is proximate to the shorting element 618 and the feed element 614, has a first width W1, while the opposite end of the L-shaped radiator has a second width W2 that is larger than W1. The additional width of W2 compared to W1 is determined by the width of the rectangular radiator 612 along axis 613*b*.

The first end of the L-shaped arm 608 is proximate to, and operably coupled to, a feed element 614 that is further coupled to a feed conductor 616, connected to a feed source, and also is proximate to, and operably coupled to, a shorting element 618 that is coupled to a shorting conductor 620 that is further coupled to ground. The feed conductor 616 is an elongated rectangular conductor having a longitudinal axis 617. Likewise, the shorting conductor 620 is an elongated rectangular conductor having a longitudinal axis 621. The feed conductor 616 and the shorting conductor 620 are in a parallel spaced apart configuration along their respective longitudinal axes. As discussed below, this configuration provides capacitive coupling between the feed conductor and the shorting conductor 620.

The embodiment of the antenna shown in FIG. 6 further comprises a second L-shaped arm 622 disposed on the printed circuit board 602, comprising a first elongated rectangular conductor element 624 having a longitudinal axis 625 and a second elongated rectangular element 626 having a longitudinal axis 627, first and second conductor elements 624 and 626, respectively. The L-shaped arm 622 provides an additional current path that enhances performance of the antenna 600.

As will be understood by those of skill in the art, there is capacitive coupling between the feed conductor 616 and the shorting conductor 620, thereby defining a "capacitor" between those two conductors. Likewise, there is capacitive coupling between the feed conductor 616 and element 626 of the second L-shaped arm 622, thereby defining a second "capacitor" between those two elements. In the embodiment shown in FIG. 6, a conductive element 628 is disposed adjacent a portion of shorting conductor 620, thereby decreasing the distance between feed conductor 616 and shorting conductor 620. In this region, the capacitive coupling is increased and, therefore, the effective capacitor formed between the two conductors represents a "tapered" capacitor. Likewise, a conductive element 629 is disposed adjacent a portion of element 626 and feed conductor 616, thereby decreasing the distance between feed conductor 616 and element 626. In this region, the capacitive coupling is increased and, therefore, the effective capacitor formed between the two conductors also represents a "tapered" capacitor.

The embodiment of the antenna shown in FIG. 6 also comprises a capacitive coupling patch 630 in an inverted L-shaped configuration comprising a first rectangular radiator 632 and a second rectangular radiator 634. The rectangular conductor 632 comprises an axis 636 that is substantially parallel with the axis 613*a* of rectangular portion 612. An axial edge 638 of rectangular radiator 632 is spaced apart from, and substantially parallel with, an axial edge 640 of rectangular radiator element 612. This configuration provides an additional source of capacitive coupling for the antenna 600.

Figure 7:
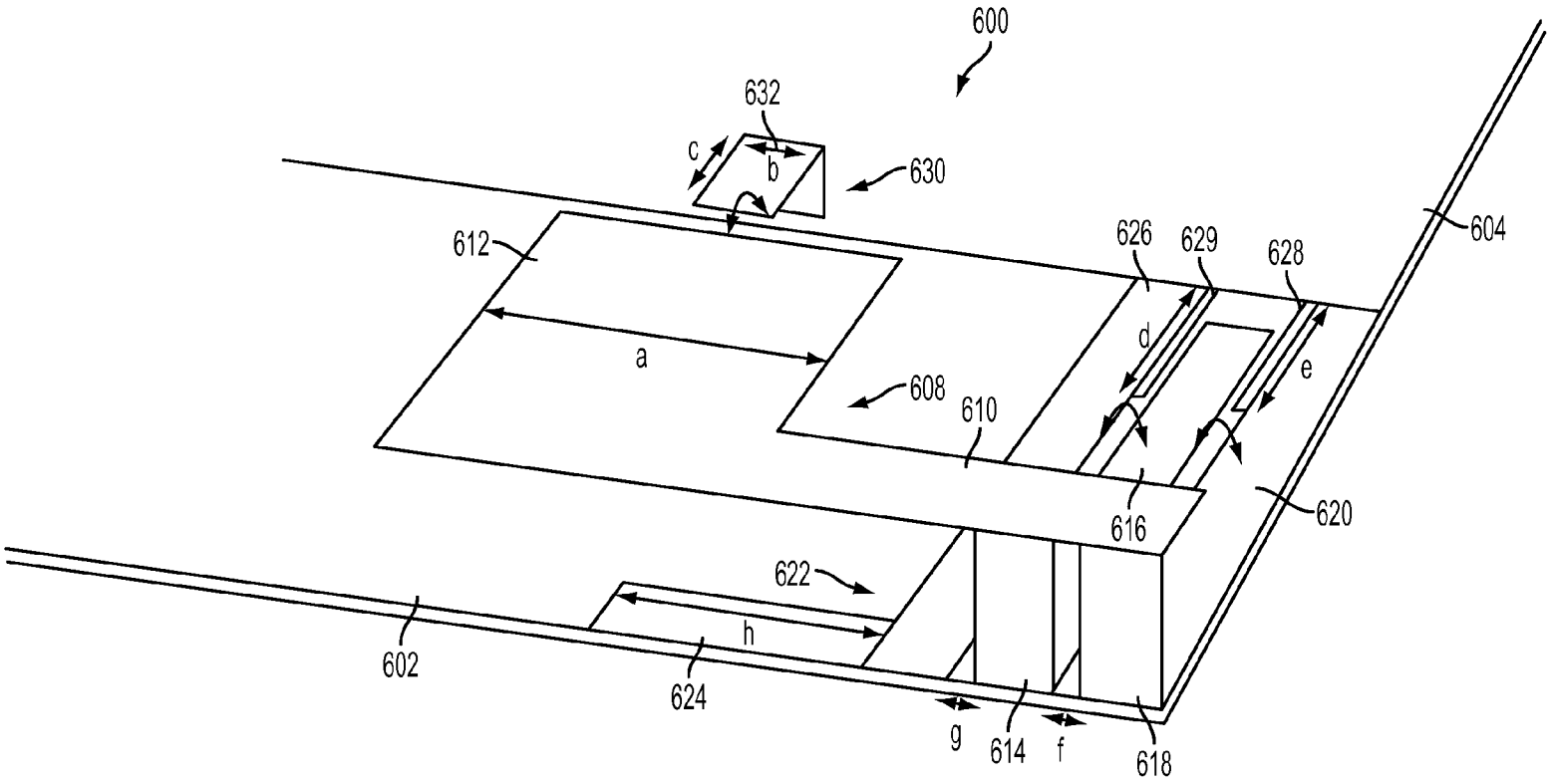
FIG. 7 is an illustration of a plurality of dimensional parameters, a-h, for the various elements of the compact broadband antenna shown in FIG. 7.

FIG. 7 is an illustration of a plurality of dimensional parameters, a-h, for the various respective elements of the compact broadband antenna shown in FIG. 6. These dimensional parameters can be varied to obtain optimized performance for the compact broadband antenna. The variation in the S-parameters for the embodiment shown in FIG. 7 will be discussed below in connection with FIGS. 8-16.

Figure 8:
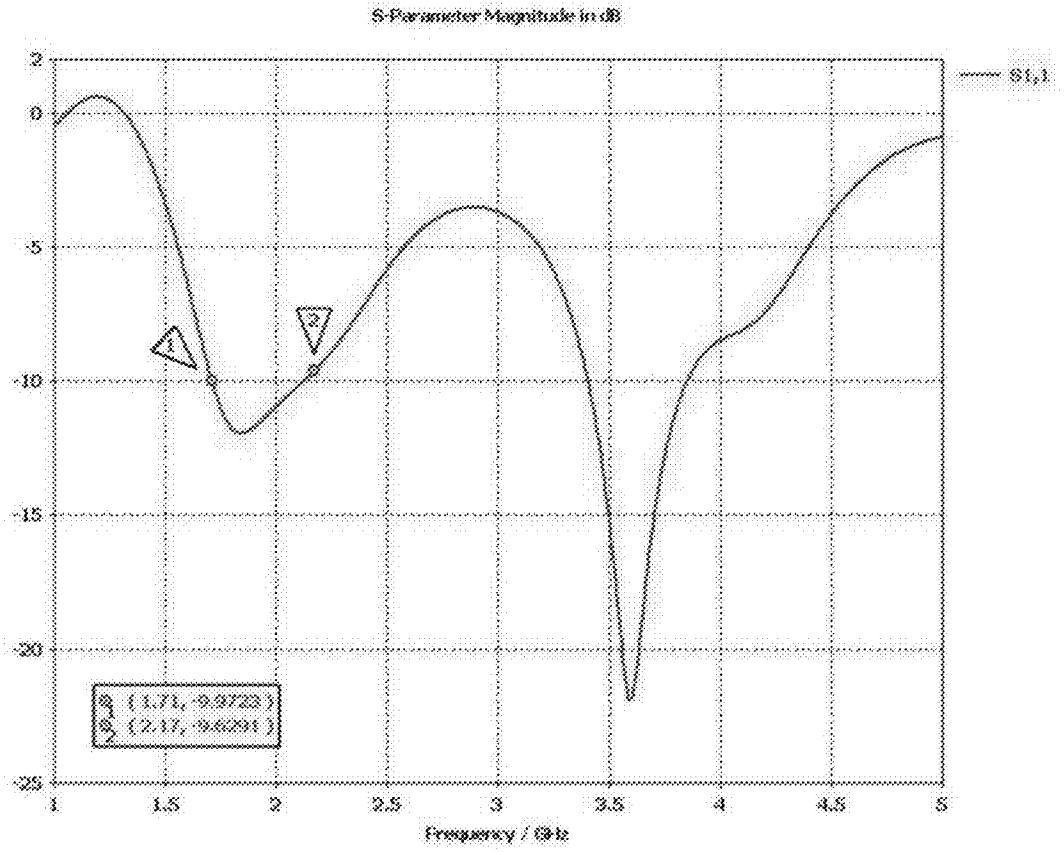
FIG. 8 is an illustration of the S parameters of the embodiment of the compact broadband antenna shown in FIG. 7.
Figure 9:
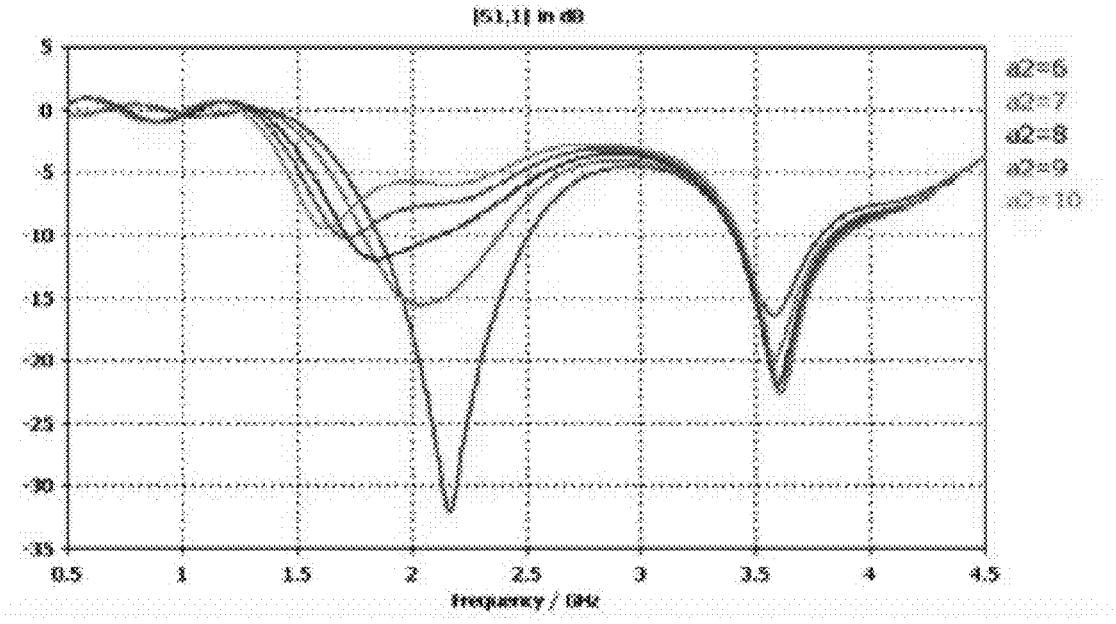
FIG. 9 is an illustration impact on the S-parameters obtained by changing parameter 'a' of the antenna 600 shown in FIG. 7.
Figure 10:
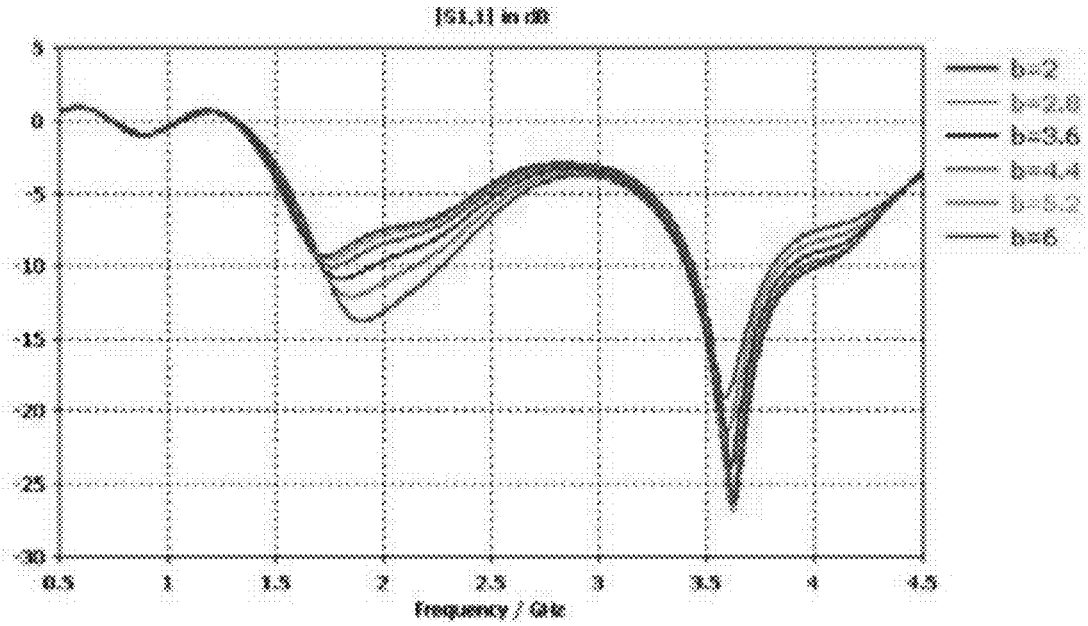
FIG. 10 is an illustration impact on the S-parameters obtained by changing parameter 'b' of the antenna 600 shown in FIG. 7.
Figure 11:
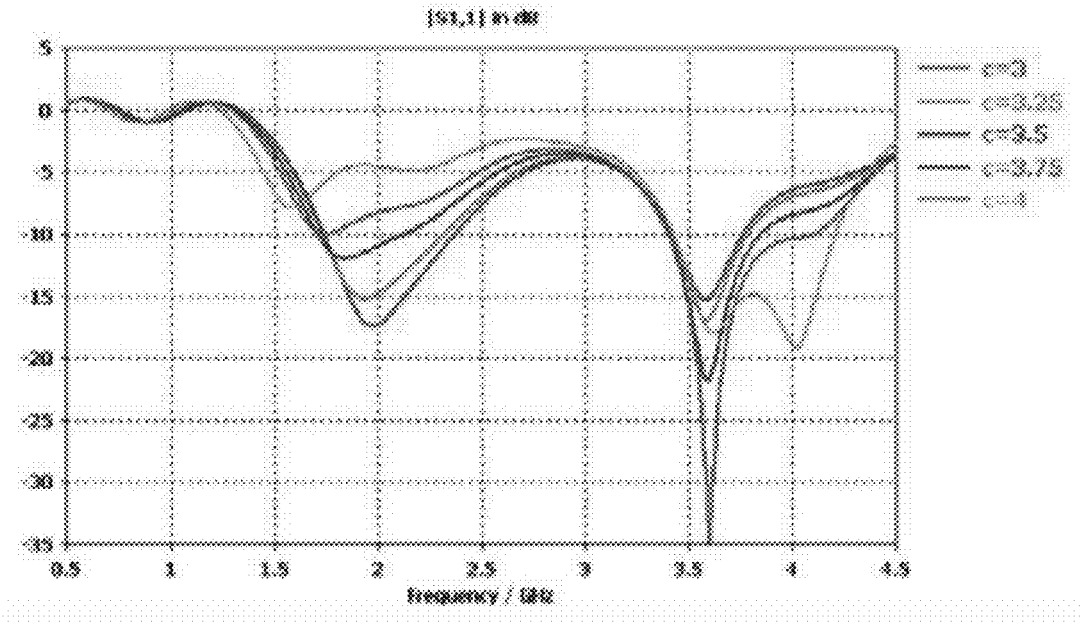
FIG. 11 is an illustration impact on the S-parameters obtained by changing parameter 'c' of the antenna 600 shown in FIG. 7.
Figure 12:
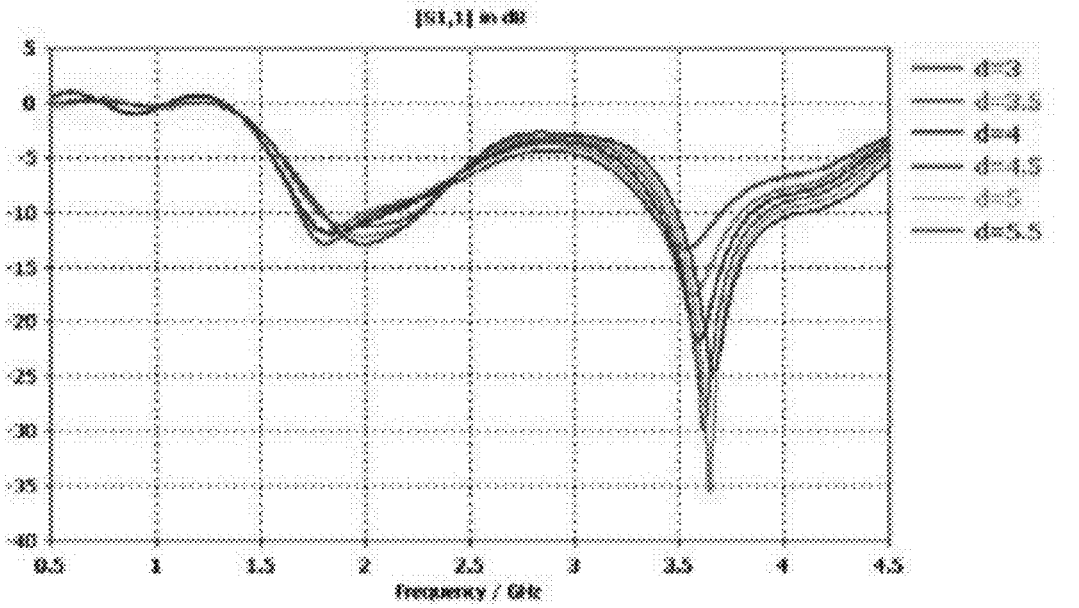
FIG. 12 is an illustration impact on the S-parameters obtained by changing parameter 'd' of the antenna 600 shown in FIG. 7.
Figure 13:
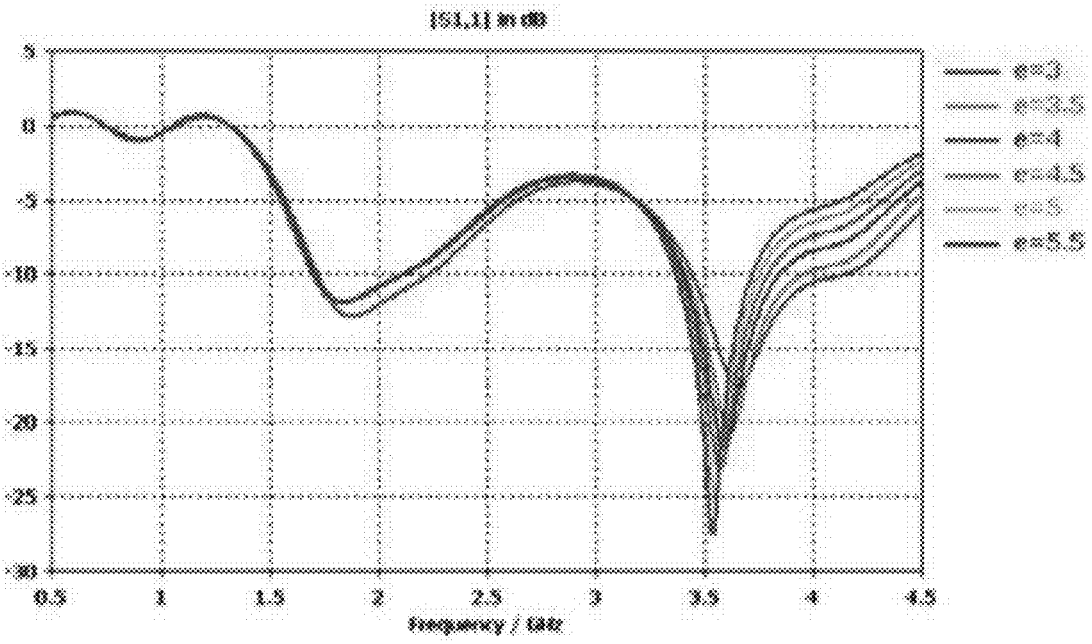
FIG. 13 is an illustration impact on the S-parameters obtained by changing parameter 'e' of the antenna 600 shown in FIG. 7.
Figure 14:
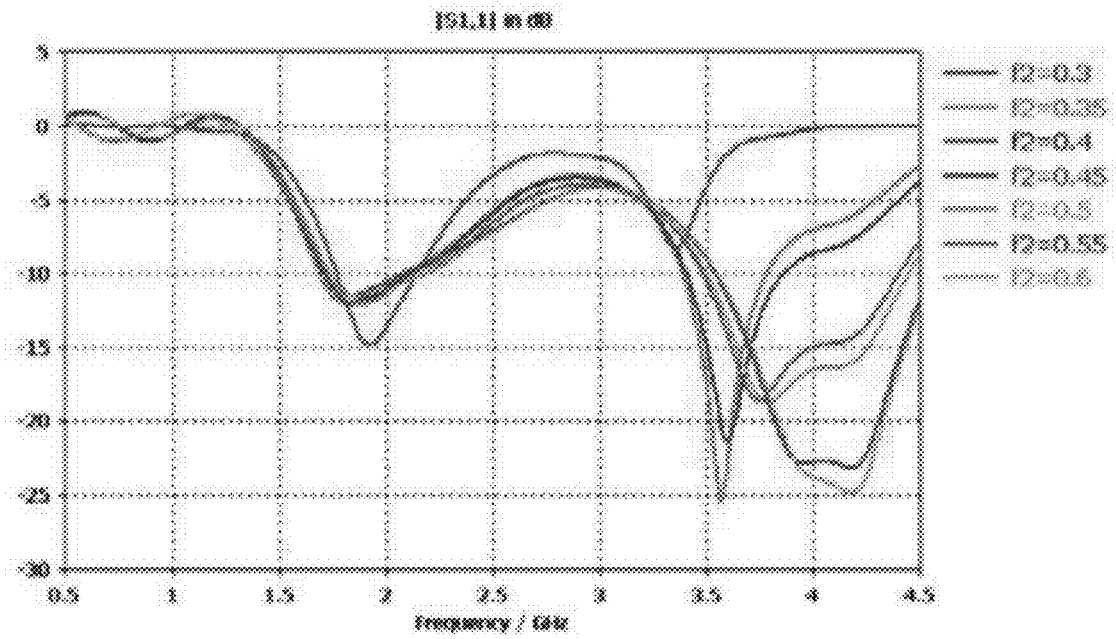
FIG. 14 is an illustration impact on the S-parameters obtained by changing parameter 'f' of the antenna 600 shown in FIG. 7.
Figure 15:
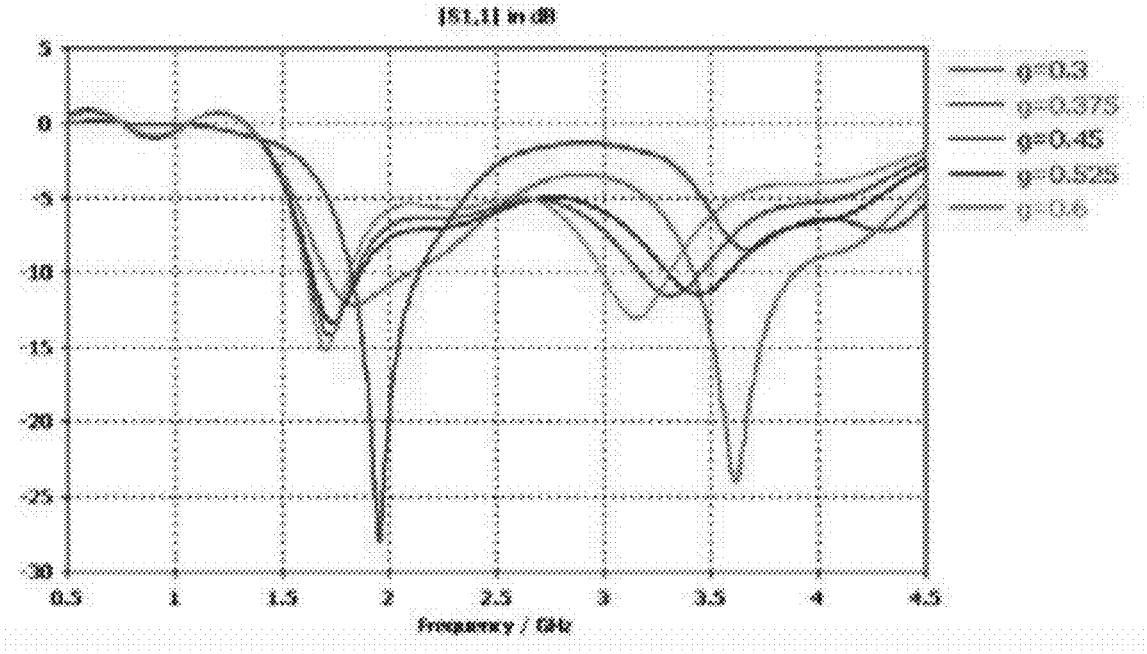
FIG. 15 is an illustration impact on the S-parameters obtained by changing parameter 'g' of the antenna 600 shown in FIG. 7.
Figure 16:
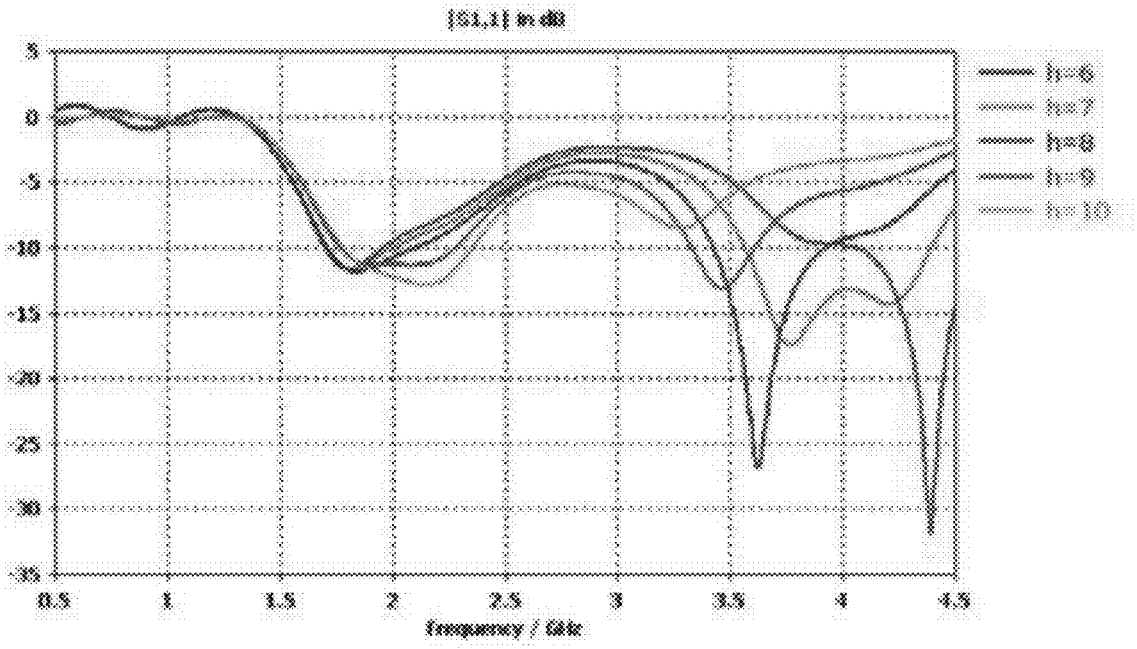
FIG. 16 is an illustration impact on the S-parameters obtained by changing parameter 'h'.

FIG. 8 is an illustration of the composite S parameters of the embodiment of the compact broadband antenna shown in FIG. 7. As shown in FIG. 8, almost −10 dB was achieved between 1.71 GHz and 2.17 GHz. FIG. 9 is an illustration impact on the S-parameters obtained by changing parameter 'a' of the antenna 600 shown in FIG. 7, over an example range of 6 to 10 millimeters. As can be seen from the graph, increasing 'a' shifts the match toward the lower frequencies. This is because the electrical size of the antenna increases as 'a' is increased. FIG. 10 is an illustration impact on the S-parameters obtained by changing parameter 'b' of the antenna 600 shown in FIG. 7, over an example range of 2 to 6 millimeters. Increasing 'b' shifts the match downward as it increases the capacitive coupling to ground. FIG. 11 is an illustration impact on the S-parameters obtained by changing parameter 'c' of the antenna 600 shown in FIG. 7, over an example range of 3 to 4 millimeters. As can be seen in FIG. 11, increasing the parameter 'c' has a similar effect as increasing the parameter 'b'. FIG. 12 is an illustration impact on the S-parameters obtained by changing parameter 'd' of the antenna 600 shown in FIG. 7, over an example range of 3 to 3.5 millimeters. Increasing the length of the parameter 'd' shifts the antenna match upward. FIG. 13 is an illustration impact on the S-parameters obtained by changing parameter 'e' of the antenna 600 shown in FIG. 7, over an example range of 3 to 5.5 millimeters. As can be seen in the graph increasing the length of 'e' has only a slight impact on antenna performance. FIG. 14 is an illustration impact on the S-parameters obtained by changing parameter 'f' of the antenna 600 shown in FIG. 7, over an example range of 0.3 to 0.6 millimeters. As can be seen in this graph, the impact of changing the parameter 'f' is similar to the impact of changing parameter 'e.' FIG. 15 is an illustration impact on the S-parameters obtained by changing parameter 'g' of the antenna 600 shown in FIG. 7, over an example range of 0.6 to 0.6 millimeters. As can be seen in the graph, changing the parameter 'g' has a strong impact on the performance of the antenna. In the band of interest, increasing 'g' shifts the match toward lower frequencies. FIG. 16 is an illustration impact on the S-parameters obtained by changing parameter 'h' of the antenna 600 shown in FIG. 7, over an example range of 6 to 10 millimeters. As can be seen in the graph, increasing parameter 'h' shifts the match toward higher frequencies.

Figure 17:
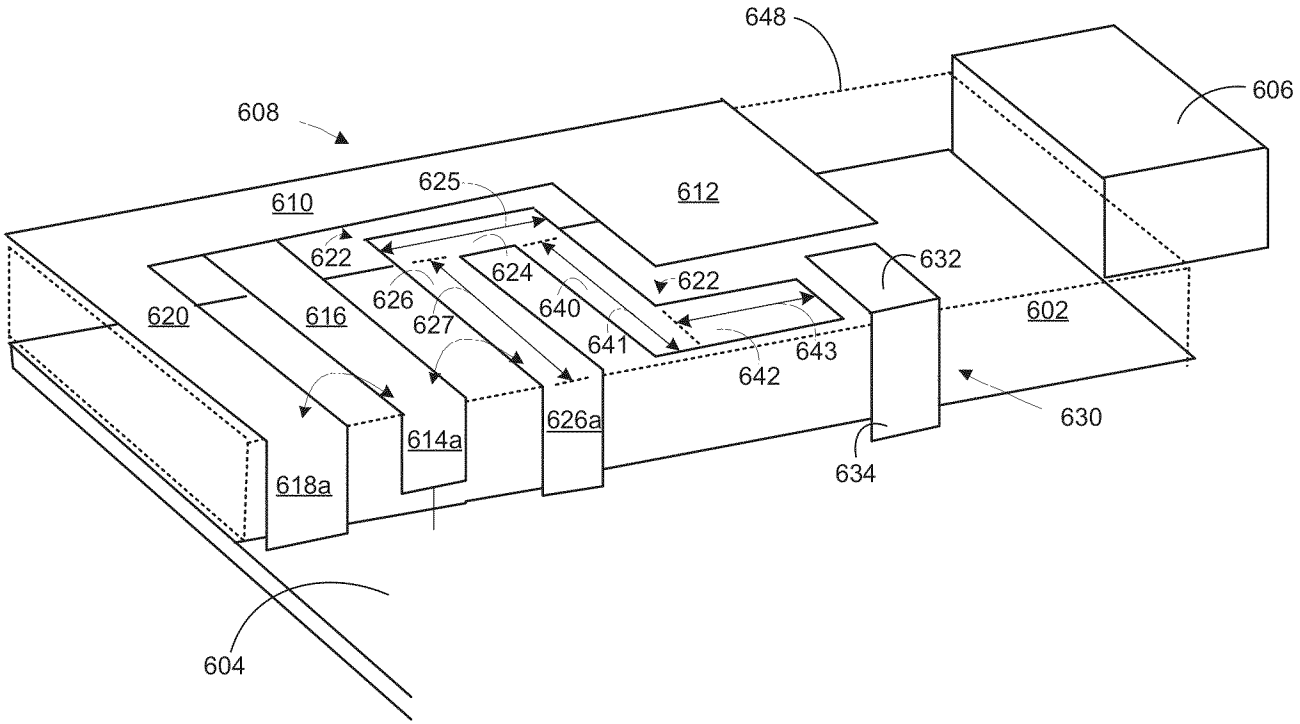
FIG. 17 is an illustration of an alternative embodiment of the compact broadband antenna of the present disclosure.
Figure 18:
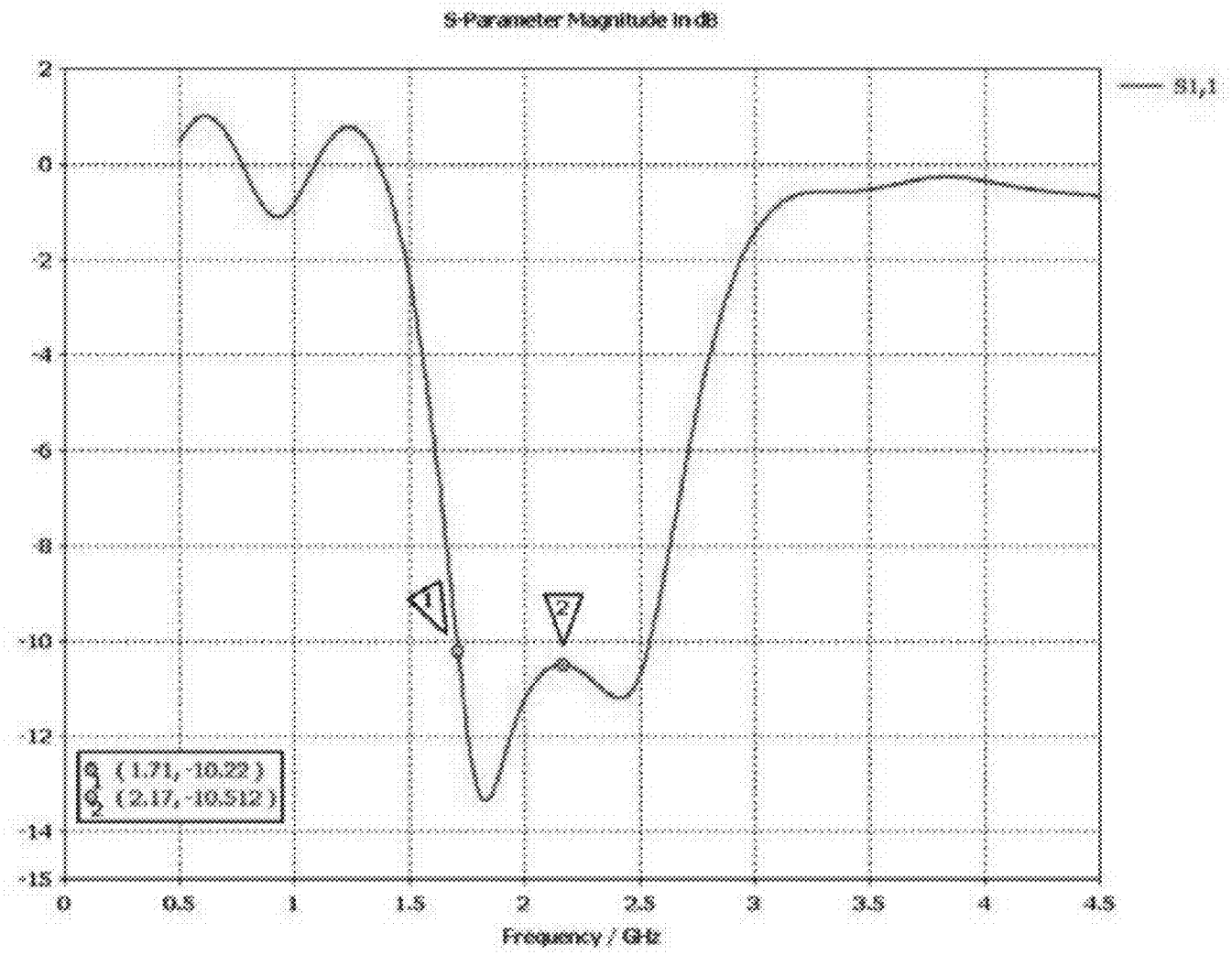
FIG. 18 is an illustration of the S-parameters of the embodiment of the compact broadband antenna shown in FIG. 17.

FIG. 17 is an illustration of an alternative embodiment of the compact broadband antenna of the present disclosure. This embodiment of the antenna comprises the elements discussed above in connection with FIG. 7; however, the entire antenna is printed on a carrier 648. Elements 614*a* and 618*a* correspond to elements 614 and 618 in FIG. 6, but are located on the opposite end of conductors 616 and 620 respectively. A portion 626*a* of radiator element 626 is coupled to ground. In this embodiment, the L-shaped radiator 622 is coupled to a second L-shaped radiator comprising radiator elements 640 and 642 attached to the distal end of element 624. The longitudinal axis 641 of radiator element 640 is substantially parallel to the axis 627 of radiator element 626. Likewise the longitudinal axis 643 of radiator element 642 is substantially parallel to the longitudinal axis 625 of radiator element 624. FIG. 18 is an illustration of the S-parameters of the embodiment of the compact broadband antenna shown in FIG. 17.

Figure 19:
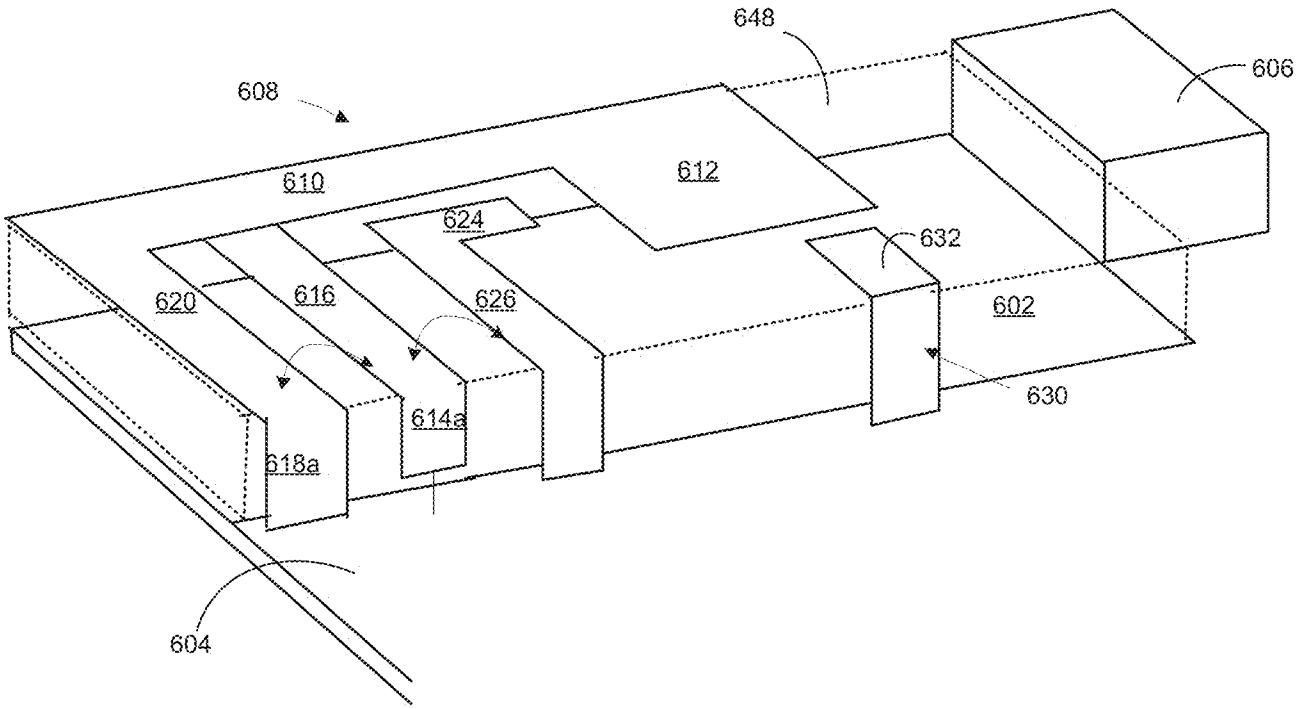
FIG. 19 is an illustration of another alternative embodiment of a compact broadband antenna in accordance with the disclosure.
Figure 20:
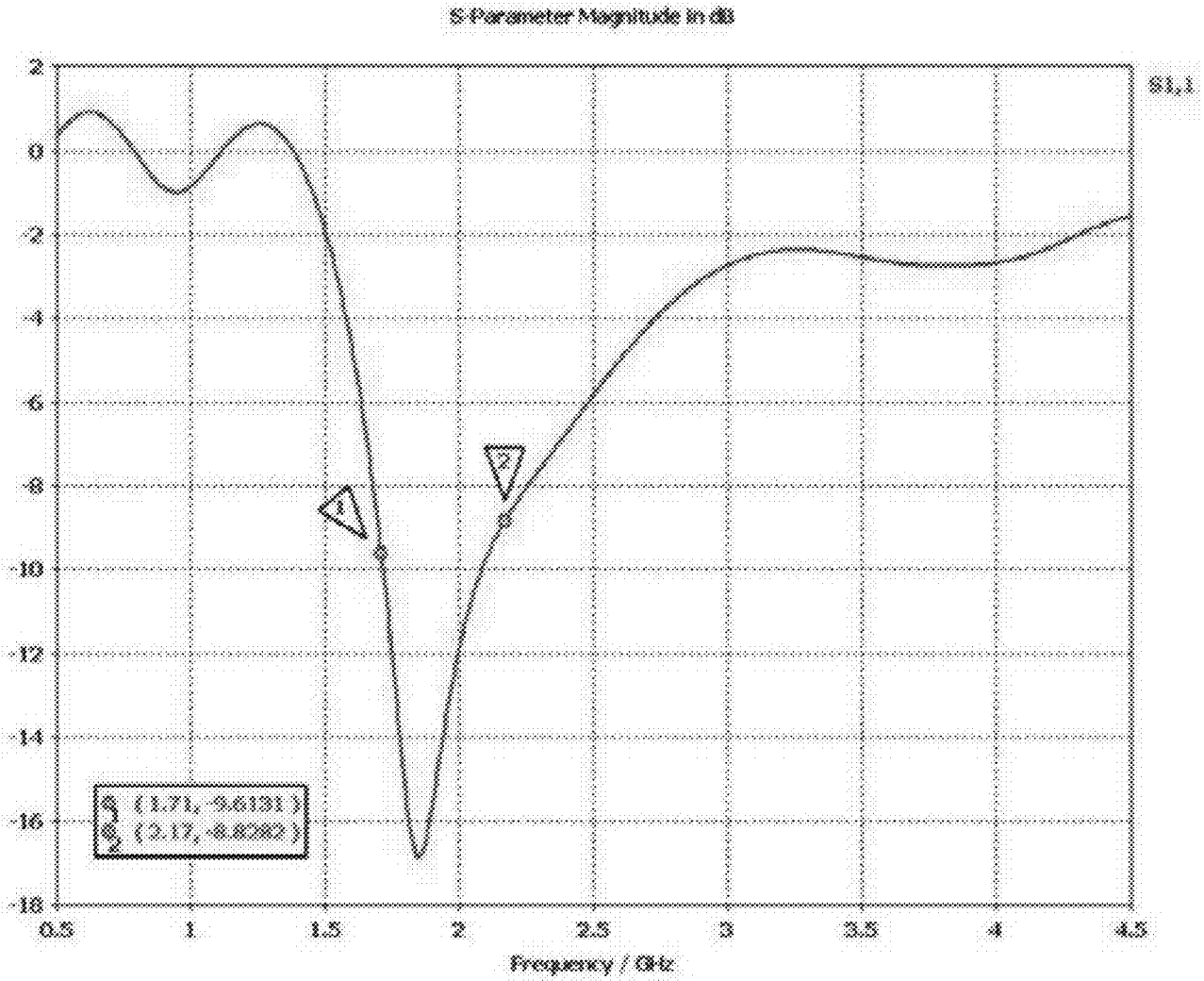
FIG. 20 is an illustration of the S-parameters of the embodiment of the compact broadband antenna shown in FIG. 19.

FIG. 19 is an illustration of another alternative embodiment of a compact broadband antenna in accordance with the disclosure. This embodiment also comprises essentially all of the elements discussed above in connection with FIG. 7. Again, the entire element is printed on the carrier, similar to the embodiment in FIG. 17. In this embodiment, however, the L-shaped radiator comprises only radiator elements 624 and 626. FIG. 20 is a graphical illustration of the S-parameters for the embodiment of the antenna shown in FIG. 19.

Although the described exemplary embodiments disclosed herein are described with reference to compact broadband antennas, the present disclosure is not necessarily limited to the example embodiments which illustrate inventive aspects of the present disclosure. Thus, the particular embodiments disclosed above are illustrative only and should not be taken as limitations upon the present disclosure, as the disclosure may be modified and practiced in different but equivalent manners apparent to those skilled in the art having the benefit of the teachings herein. Accordingly, the foregoing description is not intended to limit the disclosure to the particular form set forth, but on the contrary, is intended to cover such alternatives, modifications and equivalents as may be included within the spirit and scope of the disclosure as defined by the appended claims so that those skilled in the art should understand that they can make various changes, substitutions and alterations without departing from the spirit and scope of the disclosure in its broadest form.

What is claimed is:

1. A compact broadband antenna, comprising:

a folded inverted F radiator comprising:

a first L-shaped radiator comprising a first rectangular portion having a longitudinal axis, a first end and a first width adjacent the first end, and a second rectangular portion remote from the first end and having a second width greater than the first width, a feed element coupled to a feed source and further coupled to said L-shaped radiator proximate to said first end;

a shorting element coupled to ground intermediate the first end and the second rectangular element; and a capacitive coupling patch comprising a capacitive coupling radiator that is substantially coplanar with said second rectangular portion of said first L-shaped radiator, said capacitive coupling radiator having a longitudinal axis that is parallel to the longitudinal axis of said second rectangular portion of said first L-shaped radiator, wherein an axial edge of said capacitive coupling radiator is spaced apart from, and substantially parallel to, an axial edge of said second rectangular portion of said first L-shaped radiator.

2. The antenna of claim 1, further comprising a second L-shaped radiator comprising third and fourth elongated rectangular radiator portions, said third elongated rectangular radiator portion having a longitudinal axis parallel to said longitudinal axis of said first elongated rectangular radiator portion and said fourth elongated rectangular radiator portion having a longitudinal axis transverse to said longitudinal axis of said first elongated rectangular radiator portion.

3. The antenna of claim 1, wherein a portion of said feed element coupled to said feed source is capacitively coupled to an element coupled to ground.

4. The antenna of claim 3, wherein said capacitive coupling between said feed element coupled to said feed source and said element coupled to ground defines a capacitor between said respective elements.

5. The antenna of claim 4, wherein said capacitor between said respective elements is a tapered capacitor.

6. The antenna of claim 1, wherein a portion of an element coupled to said feed source and an element of said L-shaped radiator are located proximate to one another to form a capacitor.

7. The antenna of claim 6, wherein said capacitive coupling between said element coupled to said feed source and said element coupled to said element of said L-shaped radiator defines the capacitor between said respective elements.

8. The antenna of claim 7, wherein said capacitor between said respective elements is a tapered capacitor.

9. The antenna of claim 1, wherein components of said antenna are printed on a carrier.

10. A user equipment device comprising a compact broadband antenna, said antenna further comprising:

a folded inverted F radiator comprising:

a first L-shaped radiator comprising a first rectangular portion having a longitudinal axis, a first end and a first width adjacent the first end, and a second rectangular portion remote from the first end and having a second width greater than the first width, a feed element coupled to a feed source and further coupled to said L-shaped radiator proximate to said first end;

a shorting element coupled to ground intermediate the first end and the second rectangular element; and a capacitive coupling patch comprising a capacitive coupling radiator that is substantially coplanar with said second rectangular portion of said first L-shaped radiator, said capacitive coupling radiator having a longitudinal axis that is parallel to the longitudinal axis of said second rectangular portion of said first L-shaped radiator, wherein an axial edge of said capacitive coupling radiator is spaced apart from, and substantially parallel to, an axial edge of said second rectangular portion of said first L-shaped radiator.

11. The user equipment device of claim 10, further comprising a second L-shaped radiator comprising third and fourth elongated rectangular radiator portions, said third elongated rectangular radiator portion having a longitudinal axis parallel to said longitudinal axis of said first elongated rectangular radiator portion and said fourth elongated rectangular radiator portion having a longitudinal axis transverse to said longitudinal axis of said first elongated rectangular radiator portion.

12. The user equipment device of claim 10, wherein a portion of said feed element coupled to said feed source is capacitively coupled to an element coupled to ground.

13. The user equipment device of claim 12, wherein said capacitive coupling between said feed element coupled to said feed source and said element coupled to ground defines a capacitor between said respective elements.

14. The user equipment device of claim 13, wherein said capacitor between said respective elements is a tapered capacitor.

15. The user equipment device antenna of claim 10, wherein a portion of an element coupled to said feed source and an element of said L-shaped radiator are located proximate to one another to form a capacitor.

16. The user equipment device of claim 15, wherein said capacitive coupling between said element coupled to said feed source and said element coupled to said element of said L-shaped radiator defines the capacitor between said respective elements.

17. The user equipment device of claim 16, wherein said capacitor between said respective elements is a tapered capacitor.

18. The user equipment device of claim 10, wherein components of said antenna are printed on a carrier.

19. A compact broadband antenna, comprising:

a folded inverted F radiator comprising:

a first L-shaped radiator comprising a first rectangular portion having a longitudinal axis, a first end and a first width adjacent the first end, and a second rectangular portion remote from the first end and having a second width greater than the first width, a feed element coupled to a feed source and further coupled to said L-shaped radiator proximate to said first end, a portion of said feed element coupled to said feed source is capacitively coupled to an element coupled to ground;

a shorting element coupled to ground intermediate the first end and the second rectangular element;

a capacitive coupling patch comprising a capacitive coupling radiator that is substantially coplanar with said second rectangular portion of said first L-shaped radiator, said capacitive coupling radiator having a longitudinal axis that is parallel to the longitudinal axis of said second rectangular portion of said first L-shaped radiator, wherein an axial edge of said capacitive coupling radiator is spaced apart from, and substantially parallel to, an axial edge of said second rectangular portion of said first L-shaped radiator;

a second L-shaped radiator comprising third and fourth elongated rectangular radiator portions, said third elongated rectangular radiator portion having a longitudinal axis parallel to said longitudinal axis of said first elongated rectangular radiator portion and said fourth elongated rectangular radiator portion having a longitudinal axis transverse to said longitudinal axis of said first elongated rectangular radiator portion; and a tapered capacitor formed between said feed element coupled to said feed source and said element coupled to ground.

* * * * *